US005722243A

United States Patent [19]

Reeves

[11] Patent Number: 5,722,243

[45] Date of Patent: Mar. 3, 1998

[54] PULSED HEAT ENGINE FOR COOLING DEVICES

[76] Inventor: James H. Reeves, 216 Abert Ave., Richland, Wash. 99352

[21] Appl. No.: 748,355

[22] Filed: Nov. 13, 1996

[51] Int. Cl.[6] ..... F25B 9/00

[52] U.S. Cl. ..... 62/6; 60/520; 62/3.2

[58] Field of Search ..... 62/6, 3.2; 60/520

[56] References Cited

U.S. PATENT DOCUMENTS

| | | | |
|---|---|---|---|
| 5,357,757 | 10/1994 | Lucas | 62/6 |
| 5,385,010 | 1/1995 | Horn | 62/6 |
| 5,398,512 | 3/1995 | Inaguchi et al. | 62/6 |
| 5,481,878 | 1/1996 | Shaowei | 62/6 |

*Primary Examiner*—Ronald C. Capossela

*Attorney, Agent, or Firm*—Floyd E. Ivey

[57] ABSTRACT

A bi-directional Joule-Thomson device comprising two nearly identical heating containers which are connected via tubing to a cooling head. The cooling head is contained within a low temperature vacuum cryostat. Each of the small diameter tubes enters a chamber in the body of the cooling head. The chambers are connected by a small diameter orifice. Heat exchangers at ambient temperature and/or thermoelectric devices are used to cause the temperature of the gases entering and leaving the heating containers and cryostat to be at or near ambient. Within the cryostat, the small diameter tubes are thermally connected so that the cold gas flowing outward will cool the hotter incoming gas. The power for operation is supplied through two heating elements (one in each of the nearly identical heating vessels). This device will continue to perform at reduced power even if one of the heating elements fails.

12 Claims, 4 Drawing Sheets

PULSED HEAT ENGINE FOR COOLING DEVICES

BACKGROUND FOR THE INVENTION

1. Field of the Invention

The instant invention relates generally to cooling devices, and more specifically it relates to a Joule-Thomson, compression/expansion, or pulse tube cooling device with no moving parts in which compression is affected by controlled pulsing of electrical power to heating elements or electrodes in tubes containing an appropriate gas or mixture of gases.

2. Description of the Background Art

Various devices which utilize compressed gas produced via mechanical, acoustic, or thermoacoustic compressors and which utilize the Joule-Thomson effect, compression/expansion, or pulse tube technique for cooling have been provided in the prior art. U.S. Pat. No. 4,779,428 to Chan et al and U.S. Pat. No. 5,269,147 to Ishizaki et al are illustrations of such prior art. The present invention as hereinafter described is a cooling device with no moving parts made possible by utilizing a means for compression which entails no moving parts and offers precise, instant control of both the timing and power of each compression.

Chan, Chung K. and Gatewood, John R.

Joule-Thomson Refrigerator

U.S. Pat. No. 4,779,428

A bi-directional Joule-Thomson refrigerator is described, which is of simple construction at the cold end of the refrigerator. Compressed gas flowing in either direction through the Joule-Thomson expander valve and becoming liquid is captured in a container in direct continuous contact with the heat load. The Joule-Thomson valve is responsive to the temperature of the working fluid near the valve, to vary the flow resistance through the valve so as to maintain a generally constant mass flow between the time that the refrigerator is first turned on and the fluid is warm, and the time when the refrigerator is near its coldest temperature and the fluid is cold. The valve is operated by differences in thermal coefficients of expansion of materials to squeeze and release a small tube which acts as the expander valve.

Yoshihiro Ishizaki, Kamakura and Takayuki Matsui, Fujisawa

Pulse Tube Refrigerating System

U.S. Pat. No. 5,269,147

A pulse tube refrigerating system comprising a compressing cavity for compressing a working fluid, a heat radiator connected with the compressing cavity and a regenerator connected with the heat radiator. A pulse tube is provided and connected with the heat radiator through a refrigerating section. The pulse tube is connected through a heat exchanger and a flow regulating valve with an expansion cavity which is operable with a phase difference with respect to the compressing cavity, whereby the working fluid from the compressing cavity is cooled by the heat radiator and passed through the refrigerating section into the pulse tube, the working fluid in the pulse tube being compressed by the working fluid from the refrigerating section to be increased in temperature and passed to the heat exchanger to radiate heat.

SUMMARY OF THE INVENTION

As indicated above, prior art devices which utilize the Joule-Thomson effect to accomplish cooling as well as compression/expansion refrigerators and pulse tube refrigerators have moving parts such as those found in a mechanical compressor. The instant invention uses pulsed heating to accomplish the same ends as systems which have mechanical compressors. The savings and simplicity of the instant invention over such devices of the prior art which utilize mechanical compressors can be readily seen.

The instant invention can be used to compress gas in a bi-directional Joule-Thomson refrigerator which comprises two nearly identical heating containers which are connected via small diameter tubing to a heat exchangers (preferably each tube has its own heat exchanger) at ambient temperature located proximate the exit from the heating containers and cause the temperature of the gas leaving the heat exchangers to be near ambient. The small diameter tubing leaving these heat exchangers continues to (optional) heat exchangers cooled by thermoelectric devices which cool the gas to a temperature below ambient thus increasing the cooling power of the cooling device. Small diameter tubes leaving these heat exchangers which are located proximate a low temperature cryostat continue through the two ports located on one end of the cryostat to a cooling head located near the other end. Each of the small diameter tubes enters a compartment or chamber in the body of the cooling head. These compartments or chambers are connected by a small diameter orifice. The load to be cooled is in intimate contact with the cooling head. The small diameter tubes entering the cryostat can be constructed of stainless steel or other suitable low conductivity material for a suitable length to inhibit heat entering the low temperature cryostat via conduction through the tubes. Copper or other suitable high conductivity material is used between the stainless steel tubing and the cooling head. A sufficient length of tubing to allow the cooler gas flowing outward to cool the hotter incoming gas so that the tubes are near the same temperature at the entrance to the cryostat is used. In order to minimize the length of the cryostat, the tubes are formed into coils. The pair of tubes are in intimate contact with each other throughout their entire length within the cryostat but each coil is separated from the adjacent coil.

The power for operation is supplied through two heating elements (one in each of the nearly identical heating containers). Or, power could be supplied to electrodes in the ends of each tube and gas discharge or spark gap heating would occur.

In a lesser preferred embodiment, only one of the two containers has a heating element thereon.

Lining the heating containers with a 0.0005 inch thick layer of low emissivity material such as gold, copper, or aluminum will enhance the transfer of heat energy to the gas within the tube. A gas such as nitrogen can be used to cool to temperatures near the boiling point of nitrogen. Gases such as helium, neon, or hydrogen can be used for cooling to very low temperatures but would have to be brought to below their Joule-Thomson inversion temperature by some means before the Joule-Thomson device would cool.

One of the means which could be used to bring such gases as helium, neon, or hydrogen below their Joule-Thomson inversion temperature includes using a supply of the appropriate liquid to cool the device below the Joule-Thomson inversion temperature as part of the startup procedure. Another means to accomplish this would be to utilize a device such as the instant invention which utilizes a gas such as nitrogen to cool a second device which uses a gas such as neon to cool a third device which uses a gas such as helium as part of the startup procedure. The inversion temperature for helium is about 51 degrees Kelvin.

Whereas many watts of power can be delivered to small diameter heating containers and the Joule-Thomson cooling head can be constructed of small dimensions, the instant invention lends itself well for applications with little space. The advantages of having no moving parts whatsoever makes the instant invention very attractive for those applications remotely located or difficult to maintain for other reasons. The preceding description is for a low temperature Joule-Thomson refrigerator. However, the instant invention can be used to power typical compression/expansion refrigerators and pulse tube refrigerators. With appropriate gases (freon 22 for example) applications at near ambient temperature for cooling homes, offices, hotels, etc. are possible. Other methods for heating the containers other than interior heating can be used such as heating the containers from the outside with heat originating from such sources as wood pellets, corn, gas, coal, etc., or inductive heating. The instant invention will also operate at temperatures too high for typical mechanical compressors.

Accordingly, the above mentioned problems and difficulties of the prior art are obviated by the present invention which provides for a device which utilizes the Joule-Thomson effect, compression/expansion, or pulse tube refrigeration for cooling a load but unlike the devices of the prior art, the instant invention device is powered by pulsed heat instead of mechanical compression thus providing a cooling device with no moving parts.

Thus, a primary object of the present invention is to provide a pulsed heat engine to power cooling devices that will overcome the shortcomings of the background art devices.

Another object is to provide an engine with no moving parts for a cooling device with no moving parts which yet has the same utility as prior art devices which have mechanical compressors.

Yet another object is to provide an engine which has a long lifetime for cooling devices with long lifetimes.

An additional object is to provide an engine whose cost for manufacturing is substantially lower than the prior art devices currently being used for cooling at or near the temperature of liquid nitrogen and at other temperatures.

A further object is to provide an engine which, due to its simple construction, will fit into extremely small locations and allow for the manufacture of cooling devices in various shapes to conform with the needs of the customer. This would be especially valuable in providing for a miniaturized version for low wattage units.

A still further object is to provide a device that requires low power and minimal maintenance.

A further object is to provide an engine that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
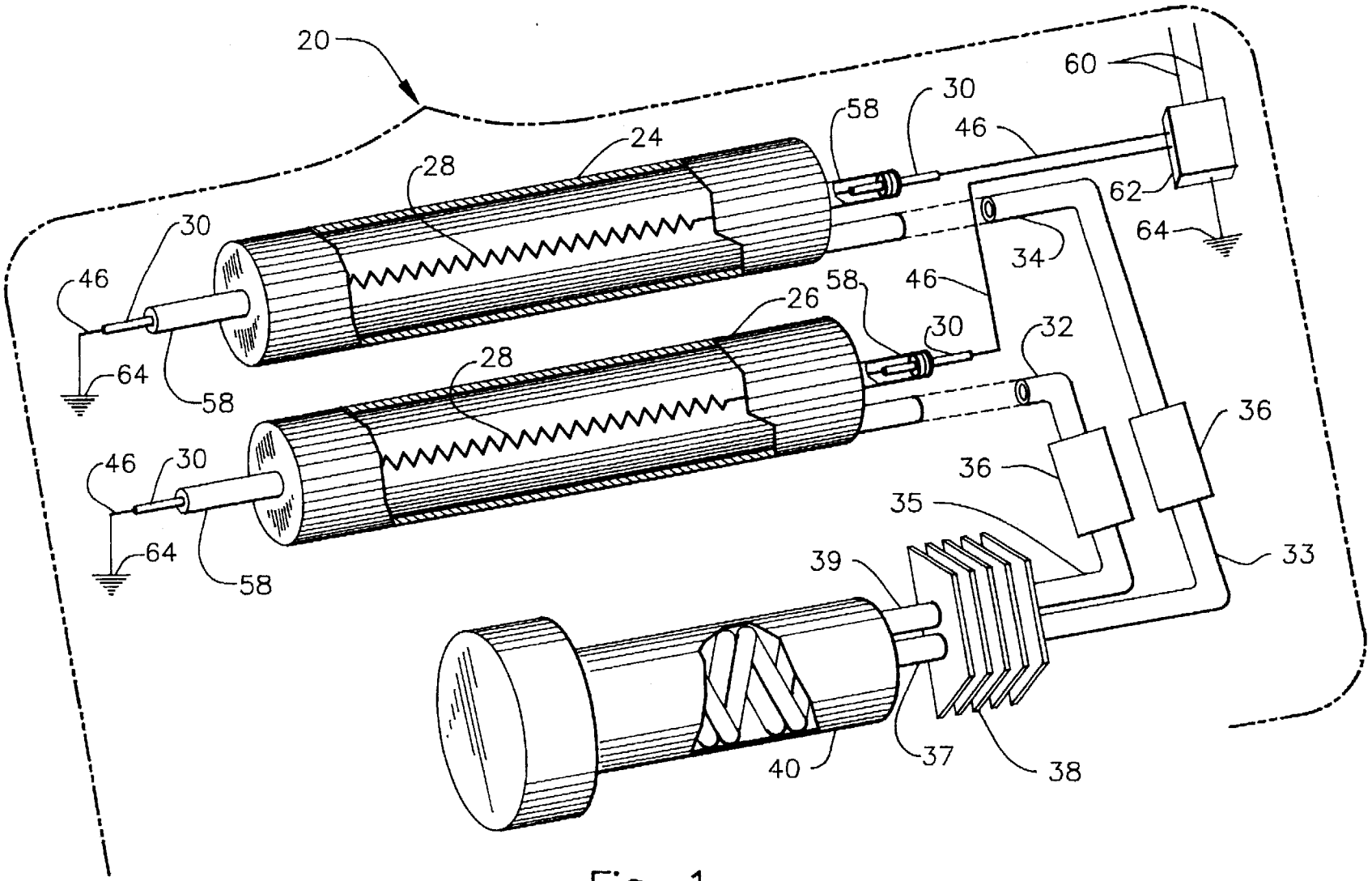
FIG. 1 is a diagrammatic perspective view of the preferred embodiment of the instant invention.

Turning now descriptively to the drawings, in which similar reference characters denote similar elements as seen in two views, FIG. 1 illustrates a perspective view of a pulsed heat powered cooling device for cooling a heat load.

Figure 2:
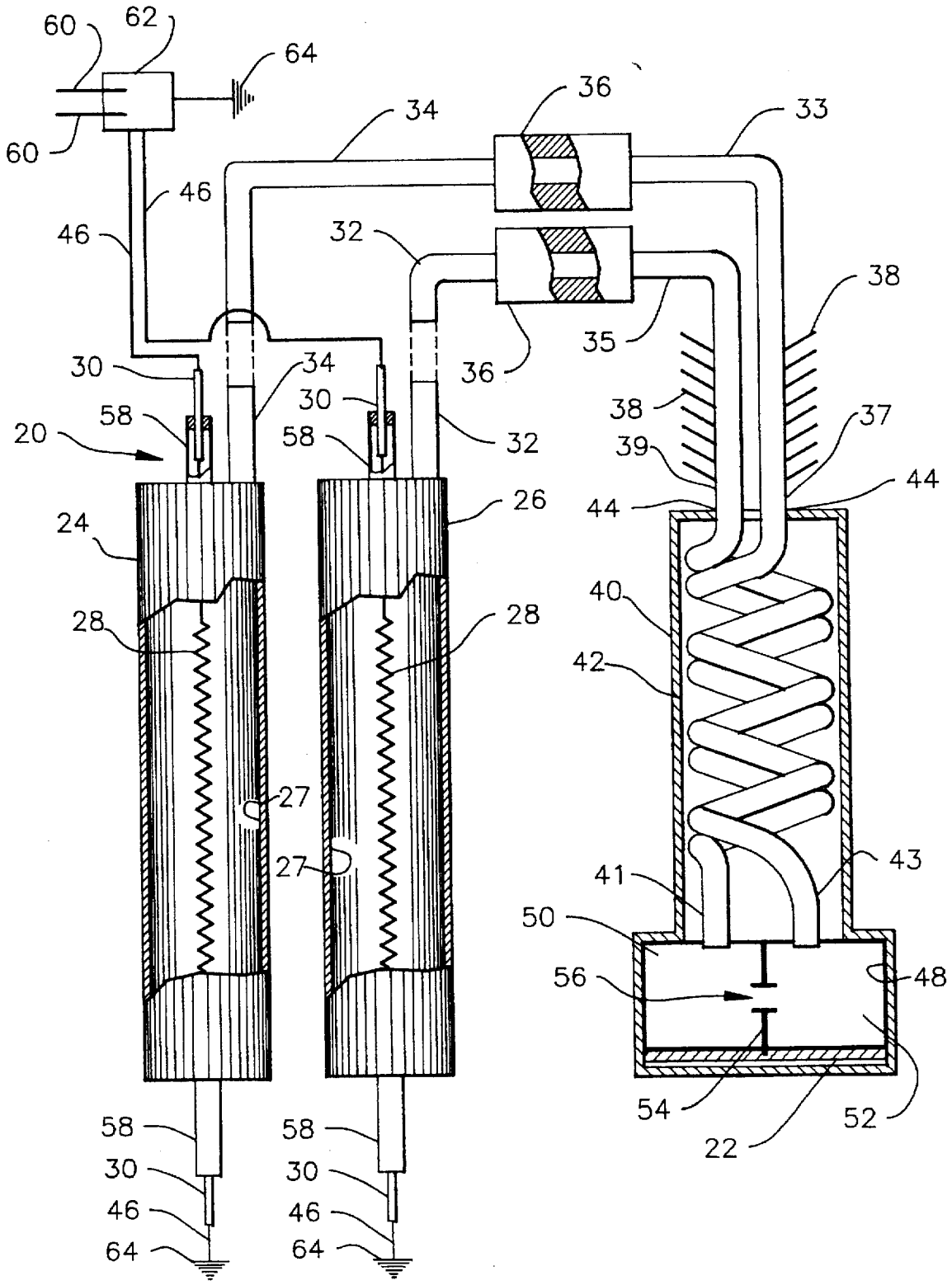
FIG. 2 is a cross sectional view with parts broken away of FIG. 1.

As shown in FIGS. 1 and 2, the electrically powered pulsed heat driven cooling device 20 for cooling a heat load 22 comprises a first heating container 24 and a second heating container 26 for heating a gas. The inside walls of both heating containers 24, 26 are lined with 0.0005 inch thick low-emissivity material 27 such as gold, copper, or aluminum. Each of the containers 24 and 26 has a heating element 28 disposed therein. The heating elements 28, 28 are electrically connected to penetrating electrodes 30 which serve as a means for receiving an electric current through electrical wires 46 from the power supply/timer 62 which receives its electric power via wires 60 which are connected to either an A/C power source or a D/C power source such as a battery.

The power supply/timer module can be as simple as a standard 60 Hz 120 volt AC circuit directed through solid state relays which are controlled by a programmable timer such as the "Micro-G" available from Z-World Engineering located at 1724 Picasso Avenue, Davis, Calif. 95616. Also, DC power can be supplied directly to solid state relays controlled similarly. Or, a DC power supply deriving its power from an AC circuit can be used to supply power to solid state relays controlled by a programmable timer. The Micro-G, for example, has the capability of adjusting the times based on predetermined possibilities which include known parameters; for example, after 4 hours the load will have reached operating temperature and the timing sequence will change to become more efficient since less power is needed, also the Micro-G can be programmed to receive data from temperature probes or other type probes and it will adjust the timing sequences accordingly. Thus, the time of occurrence, amplitude, and duration of each current pulse that reaches the heating elements 28, 28 can be controlled by a timer such as the Micro-G. The timer is configured to continually repeat the following cycle: Allow current to first gas heating container's heating element for $t_1$ seconds, disable current for $t_2$ seconds, allow current to second gas heating container's heating element for $t_1$ seconds, disable current for $t_2$ seconds, etc. For example, $t_1$ could be 0.01 seconds and $t_2$ could be 0.1 seconds. Of course these times will vary depending upon the application and should be selected for optimal performance.

A brief description of Z-World's Micro-G C-Programmable Miniature Controller follows: The Micro-G incorporates a Z180 processor with a 6.144 MHz clock, programmable timers, RS232, EPROM, SRAM, watchdog timer, and power failure detection. Sensors and actuators connect easily to the Micro-G Miniature Controller. Software can be developed for the Micro-G using a special development board that plugs into the EPROM socket of the Micro-G. When the Micro-G Controller is equipped with flash memory, it can be programmed directly from the serial port of a PC. When software Is completed and tested, it runs in EPROM or Flash EPROM.

The Micro-G Controller's specifications are as follows:

Power: Can dissipate 1.2 W at 60 degrees C. without additional heat sinking. The Micro-G itself uses about 120 mA, dissipating about 0.85 W with 12V input. Unregulated input is 9–12 VDC. Additional heat sinking can be obtained by mounting the Micro-G on the optional aluminum base plate (included in the development kit) using aluminum standoffs.

32K bytes of RAM.

Up to 512K bytes of EPROM or up to 256K bytes of Flash EPROM. Flash EPROM can be read and written under program control and retains data with power down.

Watchdog timer.

Z80 PIO (parallel input/output port) for byte or bit I/0 (12 to 14 lines). Each line is configurable as input or output. Drive capability is approximately 10 mA source or sink.

On board +5V regulator and supervisor to provide power-on and power-off reset. Input supply voltage is normally 9–12V.

RS232 channel with handshake.

555 precision timer configured as an analog input device. A 555 timer functions as an analog-to-digital converter, interfacing with external resistive sensors such as thermistors, control potentiometers, and position sensors. The 555 converts external resistance to a measurable delay in time.

Time=1.1 RC

A fairly typical resistance value, R=10K, would yield a Time of 5.17 milliseconds. (C=0.47 βF.) At the end of Time, the 555 trips a Z180 timer which is counting at about 307 kHz.

As shown in FIGS. 1 and 2, an extension 58 is shown at each end of the heating containers 24, 26. These extensions 58 encompass the greater part of the penetrating electrodes 30. The extensions 58 are not necessary except to reduce rapid heat loss through the electrodes 30 and the electric wires 46.

Gas conduits such as small diameter stainless steel tubes 32 and 34, extending from each of the heating containers run to heat exchangers 36, 36 which are cooled to near ambient temperature. Preferably, the small diameter stainless steel tubes 32 and 34 are separated during their run between the heating containers 24, 26 and the opposite end of the heat exchangers 36, 36. (If the tubes 32 and 34 simply joined during the run between the heating containers 24, 26 and heat exchangers 36, 36, then the hot gas being exhausted from a heating container would tend to heat the gas returning from the cryostat 40 which would be at or below ambient. This would increase the temperature of the gas entering the other heating container and by already being hot would decrease the amount of gas able to flow during that pulse. It is necessary that the heat in the gas leaving a heating container be transferred to the environment rather than the gas returning at this point. Most preferably, an optional additional heat exchanger 38 is utilized to cool the gas below ambient. Thus, small diameter stainless steel tubes 33, 35 extend from heat exchangers 36, 36 to heat exchanger 38 which is cooled below ambient with the aid of a thermoelectric cooling device.

Small diameter stainless steel tubes 37, 39 extend from heat exchanger 38 to a low temperature vacuum cryostat 40 where they enter at ports 44. Preferably, the vacuum cryostat 40 is insulated with super insulation 42 comprising numerous layers of thin aluminized mylar, which insulation helps prevent heat from entering from the surroundings via infrared radiation. Once inside the cryostat 40, the small diameter stainless steel tubes 37, 39 continue on for a sufficient length to inhibit heat entering the low temperature cryostat via conduction through the tubes due to the low thermal conductivity of the stainless steel. High conductivity copper tubes 41, 43 are joined to the small diameter stainless steel tubes and extend to the cooling head 48. A sufficient length of tubing is used to allow the cooler gas flowing outward to cool the hotter incoming gas so that the tubes are near the same temperature at the entrance to the cryostat. In order to minimize the length of the cryostat, the tubes are formed into coils. (Preferably each of tubes 37, 39, 41, and 43 is coiled to reduce the length of the cryostat and reduce the relative size of the emissive surface of the cryostat to that of the tubing which reduces heat pickup.)

The pair of tubes 41, 43 are in intimate contact with each other throughout their entire length within the cryostat but each tubular coil is separated from the adjacent tubular coils. Copper tubes 41 and 43 enter chambers 50 and 52 respectively in cooling head 48 which is constructed of high conductivity copper. Chambers 50 and 52 are separated by a partition 54 which has an orifice 56 therein, which provides access to each of the chambers from the other chamber, this orifice being the restrictor necessary to bring about the Joule-Thomson effect when gas flows from one chamber to the other.

For operation, nitrogen gas (used for this example) is loaded into the closed loop system so that the gas is at about 300 psia pressure within the heating containers 24, 26, the connecting tubing 41, 43, and the cooling head 48. In operation, heat enters the system through the heating elements 28 and from the load at the cooling head. Heat is expelled from the system through the walls of the heating containers 24, 26 and via the heat exchangers 36, 38.

In operation, the gas residing in heating container 24 at an ambient temperature of about 300 degrees Kelvin is heated rapidly to about 600 degrees Kelvin by passing a pulse (or a series of pulses) of current through its heating element 28. If the inside of each heating container is coated with about 0.0005 inch thick low-emissivity gold, copper, or aluminum, virtually all the heat given off by heating elements 28, 28 will be reflected by the walls and will be used in heating the gas. The source of this current is a power supply/timer 62 which controls the voltage, current, timing, and duration of each "pulse" which may be less than one second for some applications. This increase of pressure (from about 300 psia to about 600 psia) accompanying the increase in temperature of the nitrogen gas in heating container 24 forces some of the gas to flow out of heating container 24 through tube 34, through heat exchanger 36, through tube 33, through heat exchanger 38, through tube 37, and on through tube 41 into chamber 50 of cooling head 48. As the gas (at about 600 psia pressure) passes through orifice 56 in partition 54 and into chamber 52, cooling will occur due to the Joule-Thomson effect. The gas (now cooler and at lower pressure than before passing through the orifice 56, but at higher pressure than that of heating container 26) flows out of chamber 52, into and through tube 43 (As the cooler gas moves through tube 43 which is constructed of high conductivity copper, it is in intimate contact with tube 41 which is also constructed of high conductivity copper. Since tube 41 contains the warmer incoming gas, the outgoing gas in tube 43 will be warmed while the incoming gas in tube 41 is being cooled). The gas flow continues through tube 39, through heat exchanger 38 (whose temperature is somewhat below ambient at about 230 to 270 degrees Kelvin if thermoelectric device/heat exchanger 38 is used), through tube 35, through heat exchanger 36 (whose temperature is about ambient), through tube 32, and then (at a temperature near ambient) into heating container 26. Since the volume in each heating container is much greater than the volume of all the small diameter tubing and the cooling head, the total volume of gas flowing from the heated container and through the cooling head is controlled primarily by the size and heat transfer characteristics of the heating containers, the size of the orifice 56, and the magnitude and duration of the heat pulse applied to the heating container being heated. The temperature of the gas in the heating container that is near ambient affects the volume of gas that flows but is determined by the above mentioned factors. After some time t, the pressure in the two heating containers 24, 26 will begin to equalize (at a pressure of about 450 psia) at which time cooling will approach zero. This concludes the first half cycle of operation. The temperature of the gas in both heating containers will begin to drop due to the transfer of heat to ambient. However, the temperature of the gas in heating container 24 will drop faster initially since it is at a higher temperature (about 600 degrees Kelvin) and the mass of gas is less. Therefore, the gas will begin to flow in the opposite direction. At this time, the gas residing in heating container 26 is heated rapidly to about 600 degrees Kelvin by passing a pulse (or a series of pulses) of current through its heating element 28. Since the pressure of the gas in heating container 26 was at about 450 psia before heating element 28 was pulsed, the pressure will approach 900 psia when the gas is heated to 600 degrees Kelvin and since the pressure in heating container 24 is at about 450 psia (and decreasing due to the cooling of the vessel and the gas via transmission of heat to ambient), the nitrogen gas will flow (rapidly at first) out of heating container 26 and back through the tubing and heat exchangers to chamber 52 in cooling head 48. As the gas passes through orifice 56 into chamber 50 cooling will again occur due to the Joule-Thomson effect. The gas will continue to flow through the tubing and heat exchangers until it enters heating vessel 24 thus completing the second half of the first cycle. A second cycle is initiated by again pulsing the heating element 28 in heating container 24. The pressures during this and repeated cycles will be similar to those of the second half of the first cycle. The preceding steps are cyclically repeated for sustained operation. The final highest temperature in the heating containers is dependent primarily upon the rate at which heat is lost from the containers to ambient and the intensity and duration of the current pulses (or series of pulses) passing through the heating elements (assuming heat exchangers 36, 38 are of sufficient capacity to maintain fixed temperatures at their locations). For this example, these variables are such that the final highest temperature reached is 600 degrees Kelvin. Control can be maintained by observing the temperatures via temperature sensors (not shown) located at the heating containers and the cooling head and adjusting the current pulses as necessary. For certain applications, the temperature sensors are needed only to establish the operating characteristics and parameters and once these have been established, individual units can be produced without the sensors. As operation continues, the temperature of the cooling head will continue to decrease until a minimum is reached. The "heat load" including heat gained through the low-temperature cryostat will determine the minimum temperature reached unless the load is so small that the temperature at which liquid nitrogen liquifies at these pressures is reached. For this example, the lowest operating temperature at the cooling head is about 130 degrees Kelvin. It is expected that with heating vessels having a volume of 20 cubic centimeters each, the device in this example will cool a load of 250 milliwatts to 130 degrees Kelvin.

The temperature in the JT cooling head drops each half cycle as some gas is forced through the JT orifice and continues to drop until some equilibrium relative to the heat load and the physical characteristics of the gas being used and the absolute pressure at the low pressure side of the cooling head. If a pressure of 20 atmospheres is maintained, then the lowest temperature that nitrogen gas will reach is about 130 degrees Kelvin. However, if a pressure of 1.0 atmosphere is reached at the low pressure side of the JT orifice, then the lowest temperature possible is 77 degrees Kelvin. A few degrees below 77 can be obtained if less than one atmosphere is used. However, the amount of JT cooling obtained is in degrees per mole of gas per atmosphere of pressure drop. The temperature drop per mole of gas per atmosphere of delta pressure is larger at temperatures and pressures near that at which the gas will become liquid.

More total cooling will be obtained per cycle if the pressure is high (although the efficiency drops off rapidly at pressures above about 40 atmospheres for nitrogen gas). Also, the lowest temperature that can be reached with nitrogen gas is higher (about 130 degrees Kelvin at 20 atmospheres).

Figure 3:
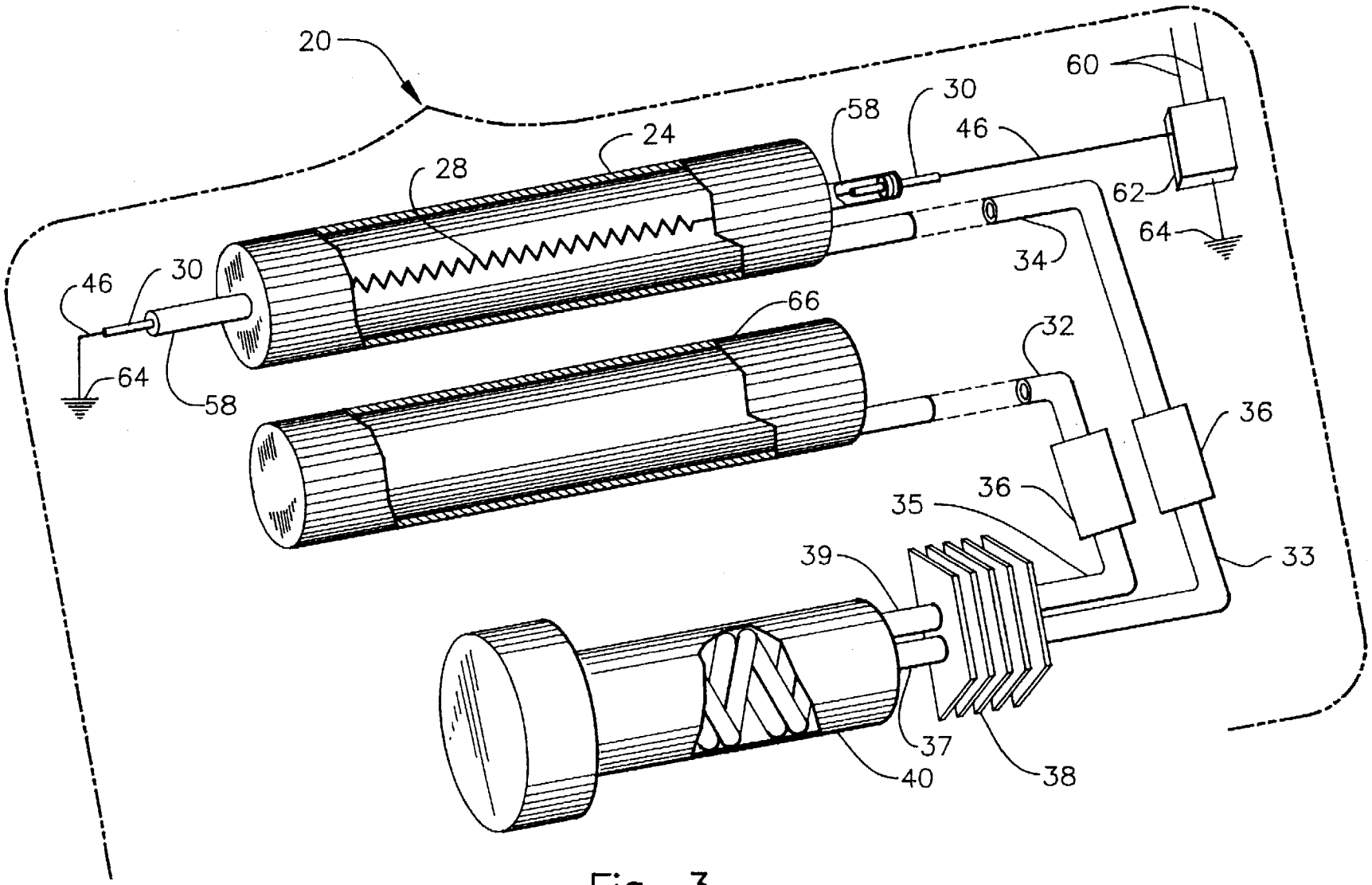
FIG. 3 is a diagrammatic perspective view of another embodiment of the instant invention.
Figure 4:
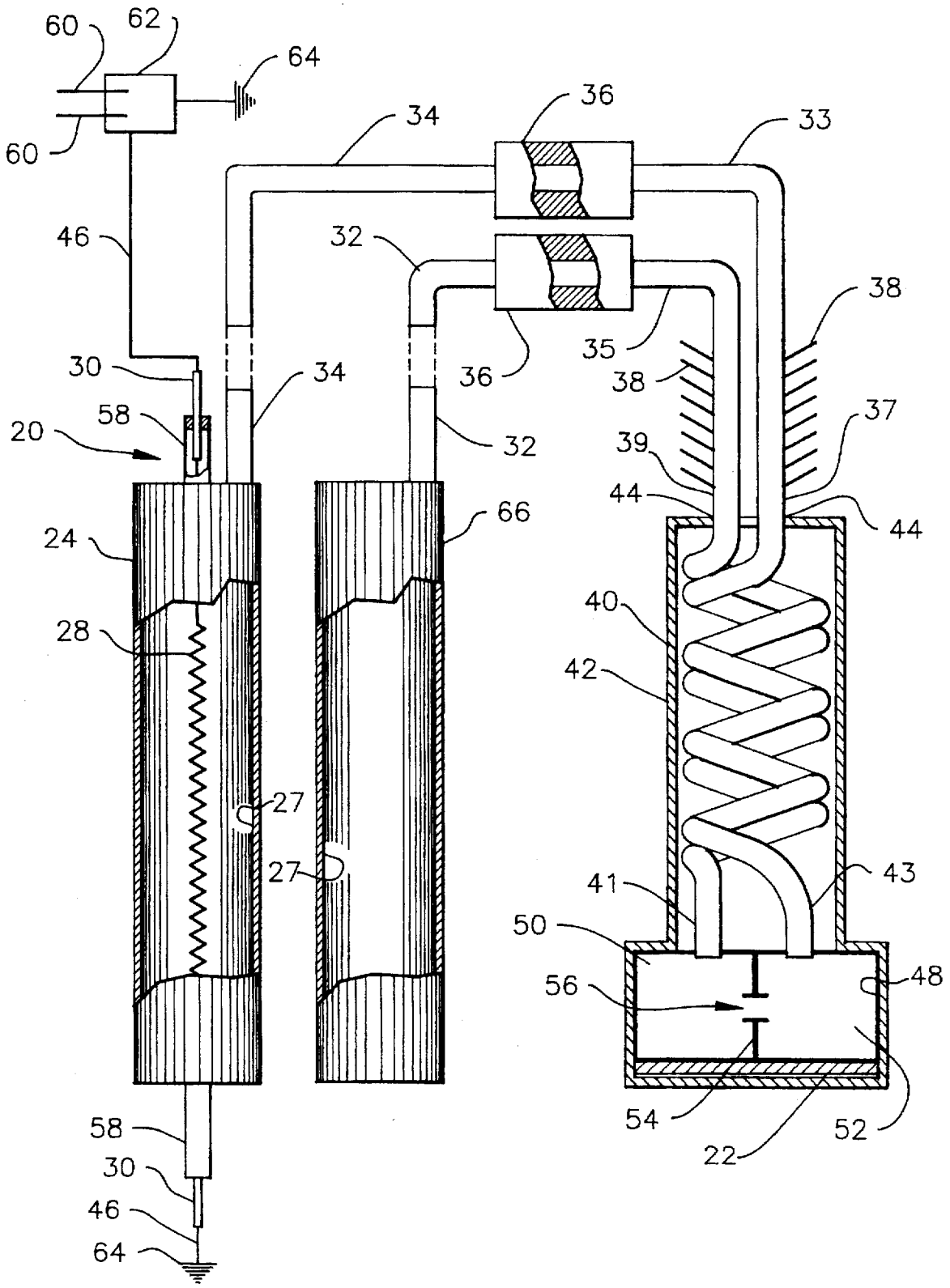
FIG. 4 is a cross sectional view with parts broken away of FIG. 3.

In another embodiment of the instant invention as shown in FIGS. 3 and 4, only the first gas container 24 contains a heating element 28. This container will be called the "heated" container, and the container that is not heated will be called the "unheated" container.

This embodiment operates as follows: Consider the apparatus in stable non-active condition at room temperature with the same pressure throughout the sealed system (perhaps 300 psia for this example). Consider what happens to the gas in each section of the apparatus when a heat pulse is applied to the heating element 28 in the heated gas container 24. Instantly, the pressure increases in the heated gas container 24 (assume a heating pulse was of sufficient amplitude and speed to double the pressure in the container 24 for an instant). Also, immediately, the pressure in the heated gas container 24 begins to fall (if the heat pulse was of short duration) because the gas begins to flow through the system all the way to and into the unheated gas container 66 (which, for this example, has no heating element). Some cooling will occur initially at the JT cooling head 48, and the pressure on the side away from the heated gas container 24 will be lower than the pressure on the side toward the heated gas container 24. As the pressure drops in the heated gas container 24 (due to its cooling as well as due to the loss of gas), flow will decrease and then cease when the pressures become equal. However, during the time that the pressure was higher in the heated gas container 24, gas will have flowed into the unheated gas container 66 and will have raised the pressure to a higher value than it was at during the non-active condition. Now, since the temperature of the heated gas container 24 will drop (it went up during the heat pulse and will go back down after the heat pulse) and since some of the gas that had been in heated gas container 24 is no longer there (having been forced out during the heat pulse), the pressure will drop below the 300 psia pressure which it exhibited during the non-active condition. Since the pressure in the unheated gas container 66 is now higher than that in the heated gas container 24, some gas will flow back into the heated gas container 24 until equilibrium is again reached (cooling will occur at the JT cooling head).

Thus, in a system in which both gas containers contain heating elements, my invention will work as long as "either" heating element is functioning. No modification of the current design is necessary in order for the invention to work in such a case. However, the cooling power of the device will be reduced if only one heating element is operating.

One of the unique applications of this device is the ability to easily locate a second stage with its heating containers being completely contained within the cooling head of the first stage. As many stages as are necessary can be used to attain the desired temperature while using gases at or near their higher Joule-Thomson efficiencies.

It should be noted that the Joule-Thomson effect for helium is negative until the temperature is reduced to about 51 degrees Kelvin (i.e., the temperature increases upon Joule-Thomson expansion at temperatures above about 51 degrees Kelvin but cools upon Joule-Thomson expansion at temperatures below about 51 degrees Kelvin). Because of this, two or three stages would be needed in order to use helium to cool to low temperatures. Alternatively, a device with a single stage using helium as a working gas could be "kick-started" by cooling with some other method, such as using liquid helium to initially reduce the temperature at and near the cooling head to below 51 degrees Kelvin. The Joule-Thomson effect for nitrogen is positive at normal room temperature and nitrogen will cool via the Joule-Thomson effect even at room temperature. However, nitrogen will liquify at about 126 degrees Kelvin at pressures of about 33 atmospheres.

There are applications where a single stage using nitrogen, or other gases could be applied. For example, in infrared applications and for cooling silicon detectors (the temperature does not necessarily need to be below 126 degrees Kelvin). Also, by using some liquid helium to initiate the cooling process wherein helium is the working gas for a Joule-Thomson cooling head, the method of this invention could be used to maintain the next to outer wall of a dewar at a few degrees Kelvin which would reduce the use rate of liquid helium contained within the dewar. Cooling computer components could be accomplished with only one stage using nitrogen or other gases.

LIST OF REFERENCE NUMBERS 20 pulsed heat driven cooling device
22 heat load
24 first gas heating container
26 second gas heating container
27 0.0005 inch thick layer of low emissivity gold, copper, or aluminum
28 heating element
30 penetrating electrodes for receiving an electric current
32 small diameter stainless steel tube between second heating container and ambient temperature heat exchanger
33 small diameter stainless steel tube between ambient temperature heat exchanger and thermoelectric cooled heat exchanger in line to first heating container
34 small diameter stainless steel tube between first heating container and ambient temperature heat exchanger
35 small diameter stainless steel tube between ambient temperature heat exchanger and thermoelectric cooled heat exchanger in line to second heating container
36 ambient temperature heat exchanger
37 small diameter stainless steel tube between thermoelectric cooled heat exchanger and initial section of cryostat in line to first heating container
38 thermoelectric cooled heat exchanger
39 small diameter stainless steel tube between thermoelectric cooled heat exchanger and initial section of cryostat in line to second heating container
40 low temperature vacuum cryostat
41 small diameter high conductivity copper tube between the stainless steel tube which entered the cryostat and the cooling head in the cryostat in line to first heating container
42 layers of thin aluminized mylar
43 small diameter high conductivity copper tube between the stainless steel tube that entered the cryostat and the cooling head in the cryostat in line to second heating container
44 entrance/exit ports to cryostat
46 electric wires
48 cooling head, constructed of high conductivity copper
50 first chamber of cooling head
52 second chamber of cooling head
54 partition between chambers
56 small diameter orifice in partition
58 extension
60 electric wires for receiving power from either an A/C power source or a battery.
62 power supply/timer
64 electrical ground for the power supply/timer
66 second gas container (the unheated gas container)

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electrically powered pulsed heat engine for cooling a heat load, said heat engine comprising:

(a) first and second containers for heating a gas, each said container having an inner surface and an outer surface, at least one of said containers having a heating element disposed therein;

(b) means for receiving an electric current from a source of electric power, said means being electrically connected to said heating elements;

(c) at least one heat exchanger for maintaining the temperature of gases near ambient temperature;

(d) a low temperature vacuum cryostat, said cryostat having a gas port for the entrance and exit of gas, a cooling head provided with access to said gas port, said cooling head having a first chamber, a second chamber, and a partition, said two chambers being separated by said partition, said partition having an orifice therein, whereby access is provided from each said chamber to the other said chamber, said two chambers of cooling head being in thermal contact with the heat load; and (e) a first conduit connected to and extending from the first gas heating container, coming into substantial thermal contact with said heat exchanger, and continuing on to said gas port of said cryostat, and a second conduit connected to and extending from the second gas heating container, coming into substantial thermal contact with said heat exchanger, and continuing on to said gas port of said cryostat.

2. The pulsed heat engine described in claim 1, wherein said first and second conduits are thermally coupled to said heat exchanger from a point at a predetermined distance from said first and second heating containers and continuing to remain in substantial thermal contact with each other as they continue to the port of the cryostat.

3. The pulsed heat engine described in claim 1, wherein said vacuum cryostat further comprises super insulation comprising a plurality of thin aluminized mylar layers whereby heat is prevented from entering from the surroundings.

4. The pulsed heat engine described in claim 1, wherein said heat exchanger comprises at least one thermoelectric device.

5. The pulsed heat engine described in claim 1, wherein said means for receiving electric power comprises electrical wiring.

6. The pulsed heat engine described in claim 1, wherein said means for receiving electric power further comprises extensions which encompass said electric wiring, whereby rapid heat loss through the electrical wiring is reduced.

7. The pulsed heat engine described in claim 1, wherein said inner surface of each said heating container has a 0.0005 inch thick layer of a low-emissivity material disposed thereon.

8. The pulsed heat engine described in claim 7, wherein said low-emissivity material is selected from the group consisting of gold, copper, and aluminum.

9. A method of utilizing a device for cooling a heat load, said device comprising a first gas container having a heating element disposed therein, a second gas container having a heating element disposed therein, at least one heat exchanger connected to the gas heating containers by conduits, and a cooling head having two chambers separated by a partition having an orifice connecting the two chambers, said method comprising:

(a) heating a gas in a first gas heating container for a duration of time, thus increasing the pressure of the gas in the first heating container and causing the gas to flow in a first direction through a conduit from whence the gas passes to a heat exchanger where the gas is cooled, from whence the gas flows through an orifice from a first chamber to a second chamber of said cooling head, wherein the pressure drop across said orifice results in cooling of said gas in said second chamber;

(b) allowing said gas to flow from said second chamber back through a heat exchanger and on to a second gas heating container;

(c) heating a gas in a second gas heating container for a duration of time, thus increasing the pressure of the gas in the second heating container and causing the gas to flow in a second direction through a conduit from whence the gas passes through a heat exchanger where the gas is cooled, from whence the gas flows through an orifice from a second chamber to a first chamber of said cooling head, wherein the pressure drop across said orifice results in a cooling of said gas in said first chamber, said second direction being opposite to said first direction;

(d) flowing said gas from said first chamber of said cooling head to said first gas heating container; and (e) cyclically repeating said steps of heating gas whereby said gas flows in a first direction, passes through the orifice to said second chamber, conducting gas to said second gas heating container, heating the gas thus causing it to flow in said second direction through said orifice, and conducting gas to said first gas heating container.

10. The method of utilizing a device for cooling a heat load described in claim 9, wherein said duration of time is less than one second.

11. A method of utilizing a device for cooling a heat load, said device comprising a first gas container having a heating element disposed therein, a second gas container, at least one heat exchanger connected to the gas containers by conduits, and a cooling head having two chambers separated by a partition having an orifice connecting the two chambers, said method comprising:

(a) heating a gas in the first gas container for a duration of time, thus increasing the pressure of the gas in the first container and causing the gas to flow in a first direction through a conduit from whence the gas passes to a heat exchanger where the gas is cooled, from whence the gas flows through an orifice from a first chamber to a second chamber of said cooling head, wherein the pressure drop across said orifice results in cooling of said gas in said second chamber;

(b) allowing said gas to flow from said second chamber through a heat exchanger and on to the second gas container;

(c) allowing the gas in the second gas container to flow in a second direction through a conduit from whence the gas passes through a heat exchanger where the gas is cooled, from whence the gas flows through an orifice from a second chamber to a first chamber of said cooling head, wherein the pressure drop across said orifice results in a cooling of said gas in said first chamber, said second direction being opposite to said first direction;

(d) allowing said gas to flow from said first chamber of said cooling head to said first gas container; and (e) cyclically repeating said steps of heating gas whereby said gas expands in a first direction, passes through the orifice to said second chamber, conducting gas to said second gas container, allowing said gas to flow in said second direction through said orifice, and conducting gas to said first gas container.

12. The method of utilizing a device for cooling a heat load described in claim 11, wherein said duration of time is less than one second.

* * * * *